US012376697B2

(12) United States Patent
Aresu

(10) Patent No.: US 12,376,697 B2
(45) Date of Patent: Aug. 5, 2025

(54) APPARATUS FOR RECEIVING AND STORING MAIL AND/OR PARCELS CONTAINING PERISHABLE PRODUCTS

(71) Applicant: Daniele Aresu, Montano Lucino (IT)

(72) Inventor: Daniele Aresu, Montano Lucino (IT)

( * ) Notice: Subject to any disclaimer, the term of this patent is extended or adjusted under 35 U.S.C. 154(b) by 170 days.

(21) Appl. No.: 18/142,372

(22) Filed: May 2, 2023

(65) Prior Publication Data

US 2023/0355020 A1 Nov. 9, 2023

(30) Foreign Application Priority Data

May 3, 2022 (IT) ..... 202022000001760

(51) Int. Cl.
*A47G 29/14* (2006.01)
*A47G 29/30* (2006.01)

(52) U.S. Cl.
CPC ..... *A47G 29/141* (2013.01); *A47G 29/30* (2013.01); *A47G 2029/147* (2013.01); *A47G 2029/149* (2013.01)

(58) Field of Classification Search
CPC ..... A47G 29/141; A47G 29/30; A47G 2029/145; A47G 2029/147; A47G 2029/148; A47G 2029/149; A47G 29/16; G07F 17/13; G06Q 10/08; G06Q 10/0836
See application file for complete search history.

(56) References Cited

U.S. PATENT DOCUMENTS

2007/0050083 A1* 3/2007 Signorelli ..... G07F 9/001 700/241
2015/0186840 A1* 7/2015 Torres ..... A47F 10/02 705/339
2015/0371187 A1* 12/2015 Irwin ..... G06Q 10/0836 705/72
2017/0215620 A1* 8/2017 Dade ..... F25D 17/00
2017/0286905 A1* 10/2017 Richardson ..... G06Q 10/0836
2018/0242768 A1* 8/2018 Lewis ..... A47G 29/16
2018/0300677 A1* 10/2018 Wilkinson ..... G07C 9/00896
2018/0352612 A1* 12/2018 Hofleitner ..... H05B 6/10
(Continued)

FOREIGN PATENT DOCUMENTS

EP 3612061 A1 2/2020

*Primary Examiner* — Adnan Aziz
(74) *Attorney, Agent, or Firm* — Dickinson Wright PLLC; Andrew D. Dorisio

(57) ABSTRACT

An apparatus for receiving and storing mail or perishable products includes a body with a first internal cavity for mail and a second controlled temperature internal cavity for containing perishable products, a temperature conditioning device, a movable closure element allowing or preventing access to the internal cavities; a user interface device for the input and output of audio and video signals and a network interface device for placing the user interface device in communication with a remote device, and an electronic control unit which controls and manages the user interface device, the network interface device and the movable closure element. The electronic control unit generates at least one random alphanumeric code sent to the remote device, which sends an unlock signal based on the code to the electronic control unit to unlock the movable closure element and allow access to the first internal cavity or the second internal cavity.

11 Claims, 5 Drawing Sheets

(56) References Cited

U.S. PATENT DOCUMENTS

| | | | | |
|---|---|---|---|---|
| 2019/0122463 | A1* | 4/2019 | Romero | G07C 9/22 |
| 2021/0022536 | A1* | 1/2021 | Anderson | G06Q 10/0832 |
| 2021/0049846 | A1* | 2/2021 | Kashi | G07C 9/00912 |
| 2022/0114546 | A1* | 4/2022 | Carter | G05B 19/4155 |
| 2022/0117430 | A1 | 4/2022 | Aresu | |
| 2023/0115325 | A1* | 4/2023 | Thorp | G07F 9/009 340/5.73 |

* cited by examiner

APPARATUS FOR RECEIVING AND STORING MAIL AND/OR PARCELS CONTAINING PERISHABLE PRODUCTS

This application claims priority to Italian Utility Model Application No. 202022000001760 filed on May 3, 2022, the disclosure of which is incorporated herein by reference.

TECHNICAL FIELD

The present invention generally relates to an apparatus for receiving mail and parcels and, in particular, an interactive electronic apparatus, called "E-one Food Station", which allows both the receipt and storage of mail and/or parcels containing perishable products.

BACKGROUND

Mailboxes are known which use electronic opening systems, with access code, as an alternative to traditional keys. A mailbox of this type is described, for example, in document EP 3612061 in the name of the same applicant.

The current development of products sale and purchase via the Internet (the so-called "e-commerce") has significantly increased the volumes of mail and, in general, of goods delivered at the intended recipient's address. In the absence of the intended recipient, however, it can happen that the goods are not delivered and are destined to remain in storage at the carrier's warehouse or even, in some cases, they are returned to the sender. Therefore, "keyless" electronic apparatuses have been developed for receiving mail which are also capable of allowing the receipt of mail and goods in a secure manner even in the absence of the intended recipient, such as the one disclosed in document US 2022/0117430 in the name of the same applicant.

Although supported by an effective and adequate method of operation, even the most advanced "keyless" electronic apparatuses for receiving mail do not, however, allow parcels containing perishable products, such as groceries, to be received and stored therein for a predefined period of time. In fact, if the intended recipient's absence were to be prolonged for long periods of time, the products contained inside the apparatus could perish irreversibly, thus becoming unusable, or inedible if they were foodstuffs.

SUMMARY

The object of the present invention is, therefore, to provide an apparatus for receiving and storing mail and/or parcels containing perishable products which is capable of solving the aforementioned drawback of the prior art in an extremely simple, economical and particularly functional way.

In detail, an object of the present invention is to provide an apparatus for receiving and storing mail and/or parcels containing perishable products which allows these products to be stored for a predefined period of time, without triggering any deterioration process of the products.

This and other objects according to the present invention will be achieved by providing an apparatus for receiving and storing mail and/or parcels containing perishable products.

Further features of the invention are highlighted by the dependent claims, which are an integral part of the present description.

BRIEF DESCRIPTION OF THE DRAWINGS

The features and advantages of an apparatus for receiving and storing mail and/or parcels containing perishable products according to the present invention will be clearer from the following exemplifying and hence non-limiting description, referring to the attached schematic drawings in which.

DETAILED DESCRIPTION

Figure 1:
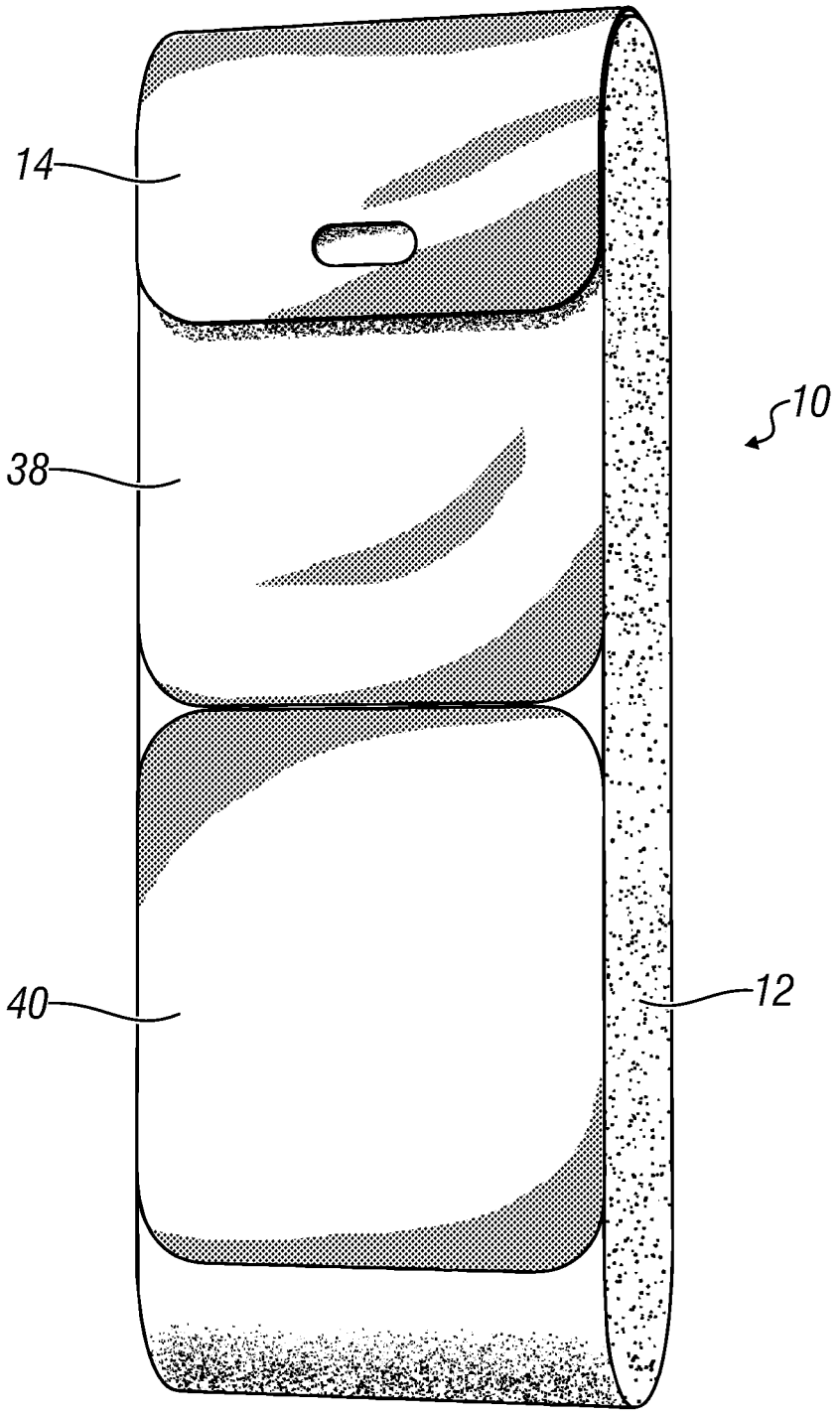
FIG. 1 is a perspective view of an apparatus for receiving and storing mail and/or parcels containing perishable products according to the present invention, wherein the apparatus is shown in its closed configuration.
Figure 2:
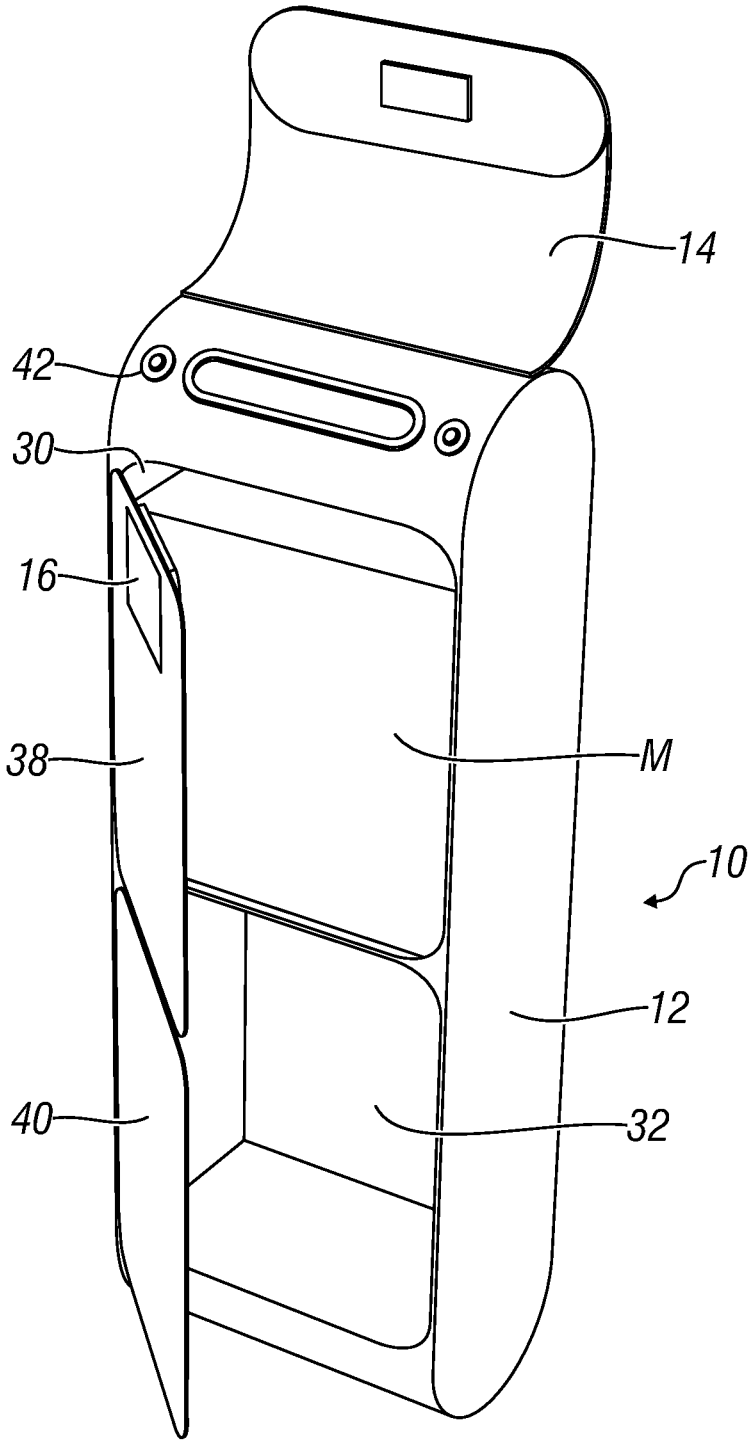
FIG. 2 is another perspective view of an apparatus for receiving and storing mail and/or parcels containing perishable products according to the present invention, wherein the apparatus is shown in its open configuration.

With reference in particular to FIGS. 1 and 2, an apparatus for receiving and storing mail and/or parcels containing perishable products according to the present invention is shown. The apparatus is indicated as a whole with reference number 10. The apparatus 10 is substantially similar to those described in documents EP 3612061 and US 2022/0117430 in the name of the same Applicant.

As shown in FIG. 1, the apparatus 10 first of all comprises a body 12 provided with at least one first internal cavity 30 arranged to contain at least one mail item M, as well as at least one movable closure element 14 arranged to allow or prevent access to the first internal cavity 30. The apparatus 10 further comprises at least one user interface device 16, configured for allowing the input and output of audio and video signals, at least one network interface device 18, configured for putting the user interface device 16 in communication with at least one remote device 20, and at least one electronic control unit 22, configured for controlling and managing both the user interface element 16, the network interface device 18 and the movable closure element 14. Preferably, the remote device 20 consists of a Smartphone, a tablet or other similar device owned by the same person who also owns the apparatus 10 which, therefore, typically coincides with the intended recipient of the mail items M ("receiving person").

Figure 3:
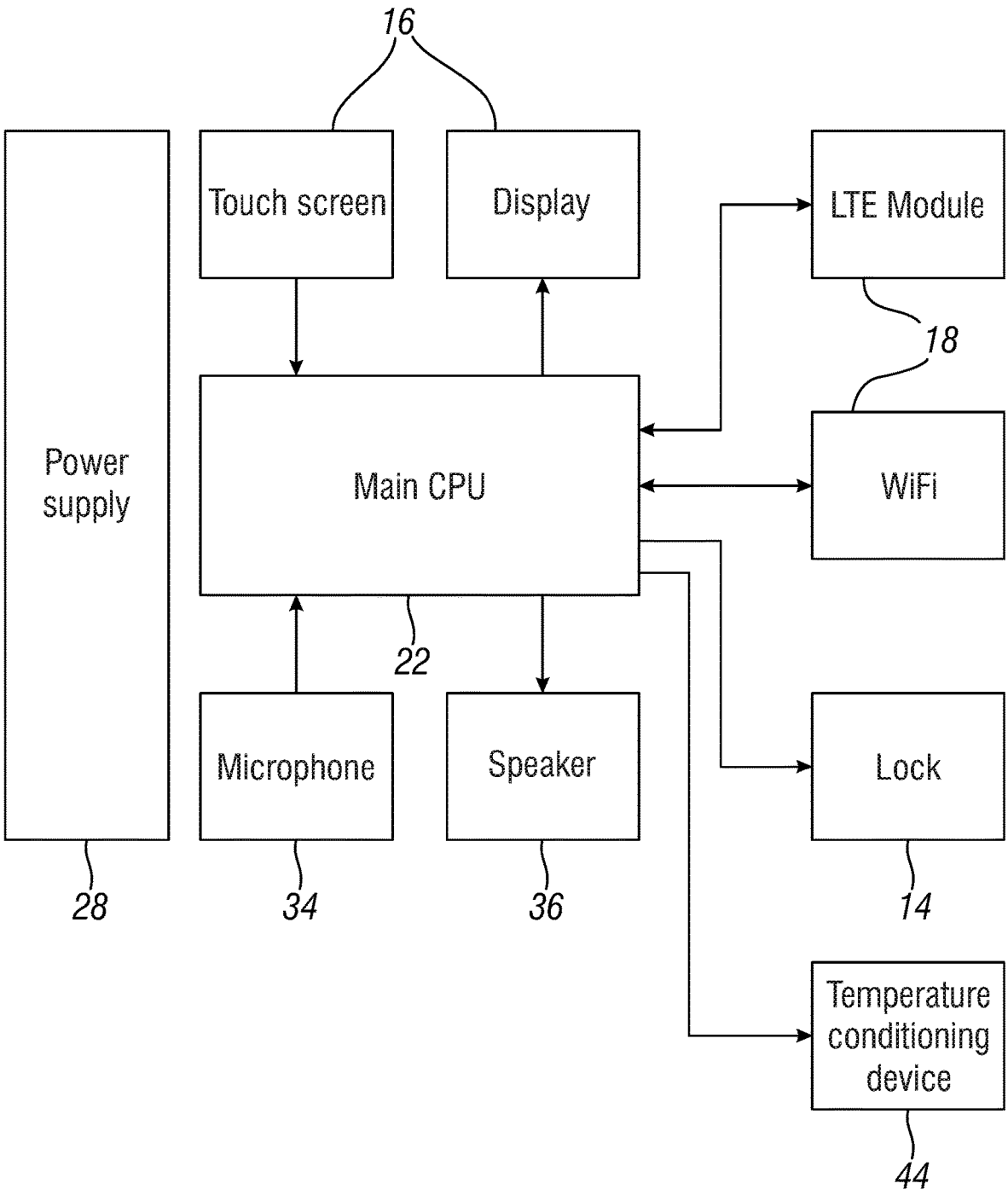
FIG. 3 is a block diagram showing the main electronic components of an apparatus for receiving and storing mail and/or parcels containing perishable products according to the present invention.

For example, as indicated in the block diagram of FIG. 3, the user interface device 16 can comprise a tactile touch screen integral with the electronic control unit 22 by means of spacers of the known type or of a suitable (plastic or metallic) frame. The electronic control unit 22 can be equipped with one or more processors capable of running a suitable operating system, such as Linux.

The apparatus 10 is provided with at least one power supply device 28 configured for electrically supplying both the electronic control unit 22 and the various peripherals via, for example, a standard micro-USB connector, so as to allow a high versatility of use. The power supply device 28 can consist of a mains power supply, that is to say which is capable of withdrawing power from the mains power, or from one or more battery packs to be charged autonomously with respect to the apparatus 10. In fact, a charging mode for autonomously charging the battery pack or packs by means of one or more solar panels 30 (not shown) positioned outside the body 12 of the apparatus 10 can be implemented on the apparatus 10. The charging mode for charging the battery pack or packs could in any case be implemented by other renewable energy sources which are alternatives to the solar power.

The electronic control unit 22 is in any case configured for maximizing energy savings. In this respect, a complete shutdown mode for shutting down all the electronic components of the apparatus 10 is provided, for example during the night hours, keeping these components at least in stand-by mode during the desired time slots. Whatever the level of energy savings, the apparatus 10, however, always remains operational, only varying the waiting time necessary before starting the respective operating procedure, which will be described below.

The apparatus 10 can be provided with at least one video camera 42 (FIG. 2) and an audio input (microphone 34, FIG. 3) and output (speaker 36, FIG. 3) system, necessary to establish a video call, preferably using a VoIP technology. The network interface device 18 can comprise both a first interface device that uses an LTE (acronym for "Long Term Evolution") connection standard, which is commonly called "4G", so as to ensure connectivity via cellular network, and a second interface device consisting of a Wi-Fi transceiver, so as to exploit any existing connection.

The network interface device 18 can in any case comprise other interface devices (not shown) suitable for the purpose, such as an interface device that uses a "5G" connection standard. The network interface device 18 can also be configured for connecting the apparatus 10 and the respective peripherals to the internet. The connection to the internet has the advantage of being able to perform firmware updates, diagnostics and maintenance remotely.

According to the invention, the apparatus 10 also comprises at least one second internal cavity 32 (FIG. 2), which defines at least one respective controlled temperature compartment for storing at least one perishable product. The perishable product may or may not be stored inside a respective package and may consist, for example, of foodstuffs, flowers, plants or any other product which needs to be kept at a controlled and predefined temperature so that it does not perish. Again by way of example, the perishable product could consist of hot foodstuffs delivered to the customers' address by food delivery companies, or again of foodstuffs, but at least partially frozen, delivered to the customers' address after online shopping by the owner of the apparatus 10.

Figure 7:
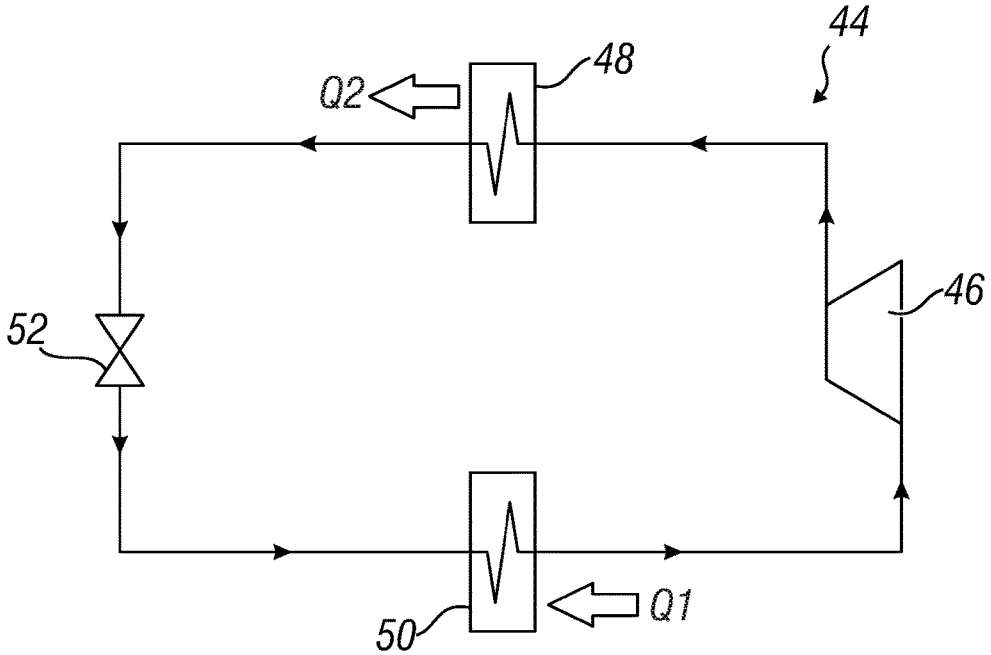
FIG. 7 shows a possible operating cycle of at least one compartment of the apparatus for receiving and storing mail and/or parcels containing perishable products according to the present invention.

The apparatus 10 therefore comprises at least one temperature conditioning device 44, which is preferably inserted in the body 12 of the apparatus 10, is powered by the power supply device 28 and operates to control the temperature inside the second internal cavity 32. For example, as shown in FIG. 7, the temperature conditioning device 44 can consist of at least one refrigerating machine comprising, in a per se known manner, a closed circuit along which a working fluid circulates and on which at least one compressor 46, at least one condenser 48, at least one evaporator 50 and at least one expansion valve 52 are provided. The refrigerating machine can operate to both extract heat from the second internal cavity 32 of the apparatus 10, and to transfer heat to the second internal cavity 32 of the apparatus 10, operating in the latter case as a heat pump. As an alternative to the refrigerating machine, the temperature conditioning device 44 can also consist of one or more thermoelectric devices, such as electric resistances, Peltier cells, etc.

The second internal cavity 32 is provided with its own closing door 40 which may or may not coincide with the movable closure element 14. Also the first internal cavity 30 can be provided with a further closing door 38 in addition to the movable closure element 14. The entire apparatus 10 can therefore be arranged for both recessing into the wall and for mounting on the outside of walls and/or other support structures.

The operating procedure of the apparatus 10 described so far is as follows. Upon arrival of a mail item M and/or any parcel whether or not containing perishable products, delivered by a carrier which can be, for example, a postman, a courier or other person authorized to deliver mail items ("delivery person"), the communication between the user interface device 16 of the apparatus 10 and the remote device 20, which typically coincides with a Smartphone or tablet owned by the receiving person, who is also the person owning the apparatus 10, is automatically activated. The receiving person is then immediately informed that a mail item destined to him/her is being delivered.

Figure 6:
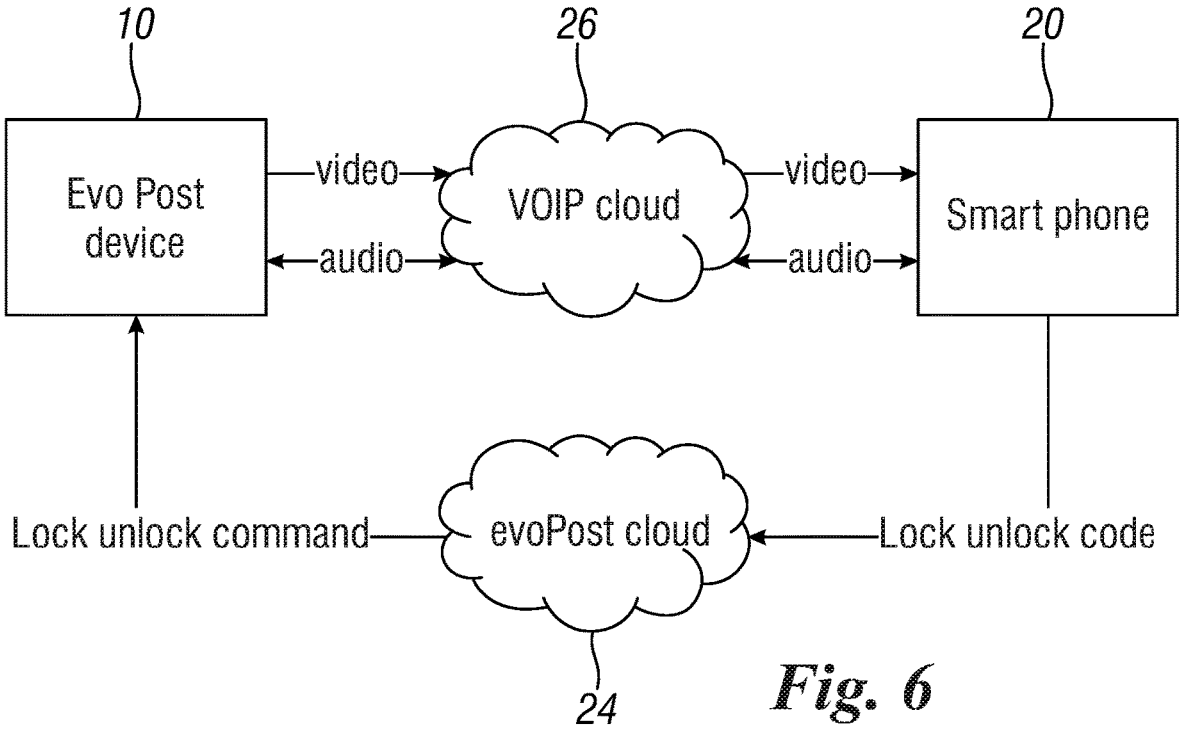
FIG. 6 is a block diagram showing another operating mode of the apparatus for receiving and storing mail and/or parcels containing perishable products according to the present invention.

Once the communication is activated, the electronic control unit 22 of the apparatus 10 generates at least one random alphanumeric code which is sent to the remote device 20 via the network interface device 18. If the receiving person decides that the apparatus 10 can be opened in order to allow the delivery person to introduce the mail item, this same receiving person can send an unlock signal based on the random alphanumeric code just received to the electronic control unit 22 of the apparatus 10, via his/her remote device 20 and the network interface device 18. The unlock signal is processed by the electronic control unit 22 to unlock the movable closure element 14 and possibly one or more of the further closing doors 38 and/or 40 of the apparatus 10, so as to allow the mail item to be introduced in the first internal cavity 30 and/or in the second internal cavity 32 of the body 12 of the apparatus 10, based on the type of mail item, by the delivery person. This operating procedure is schematically illustrated in FIG. 6.

Otherwise, if the owner of the apparatus 10 wishes to open this apparatus 10 to allow the withdrawal, rather than the introduction, of a mail or goods item in general from the first internal cavity 30 and/or the second internal cavity 32 of the body 12 of this apparatus 10, the operating procedure would be basically the same. In this case, however, the receiving person would be the one who is in the vicinity of the apparatus 10 and who wishes to take possession of the goods contained therein. In this case, for example, the receiving person could be a store customer and the apparatus 10 would be the property of that store. The delivery person would be, instead, the owner of the remote device 20 and possibly of the apparatus 10. For example, the delivery person could be the shop manager, or a clerk in charge of managing and using the apparatus 10.

This latter operating procedure of the apparatus 10, substantially "inverse" with respect to the normal methods of receiving mail items and parcels, guarantees not only the possibility of managing deliveries in the case of commercial activities, but also the possibility of returning the mail items to online marketplaces. These operations can be managed very easily, even in the absence of the owner of the apparatus 10.

Figure 5:
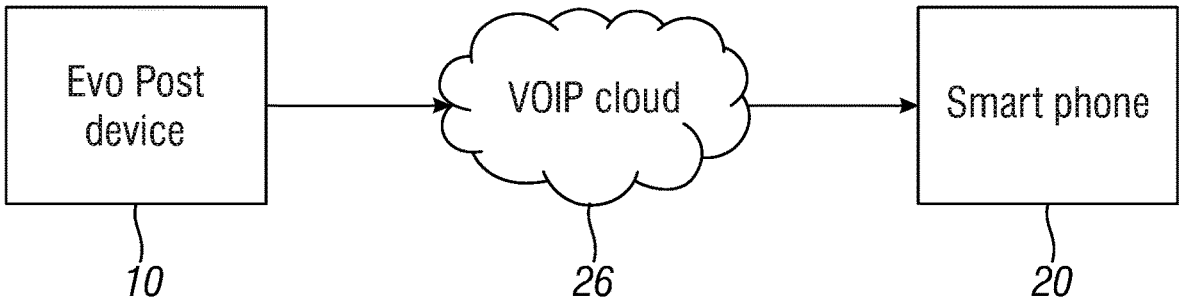
FIG. 5 is a block diagram showing an operating mode of the apparatus for receiving and storing mail and/or parcels containing perishable products according to the present invention.

If, in both the above described situations, the owner of the apparatus 10 is not available to activate the communication between the user interface device 16 and the remote device 20 or, in other words, if the owner of the apparatus 10 cannot respond to the video call established by the apparatus 10, the postman/courier (or the shop customer) could send a message to the owner of the apparatus 10 via the user interface device 16 and the network interface device 18, to inform him/her of the goods delivery (or withdrawal) attempt. The message could be of any type, that is audio and/or video and/or text. This operating procedure is schematically illustrated in FIG. 5. Again, in case of absence and/or unavailability of the owner of the apparatus 10 to make the video call, the user interface device 16 could in any case offer the alternative possibility of opening the apparatus 10 by means of a secret code previously communicated by the owner himself/herself to the person who wishes to have access to the apparatus 10.

If, in particular, the items to be withdrawn or delivered were made up of perishable goods, thus finding specific housing in the second internal cavity 32 of the body 12 of the apparatus 10, the owner of the apparatus 10 could remotely activate, again with the methods described above, the temperature conditioning device 44. The goods contained in the second internal cavity 32 of the body 12 of the apparatus 10 could therefore be kept at the most suitable temperature, set by the owner of the apparatus 10, to avoid deterioration.

All the information and/or data exchanged between the apparatus 10 and the remote device 20 are managed by one or more cloud servers 24, 26. In particular, the user interface device 16 and the remote device 20 can communicate with each other through one or more video calls using a VoIP technology. A dedicated VoIP server 26 is then installed on the cloud infrastructure, together with all the services necessary for remote management of the apparatus 10. Choosing a standard VoIP technology allows the development of customized applications, for example in a Linux environment, on the hardware architecture of the apparatus 10, guarantees interoperability between similar apparatuses 10 located at a distance from each other and allows any VoIP application existing on the market to be used to send and receive calls from the remote device 20, thus not binding the use of the apparatus 10 to a corresponding use of external services belonging to subjects other than the owner of this apparatus 10.

Figure 4:
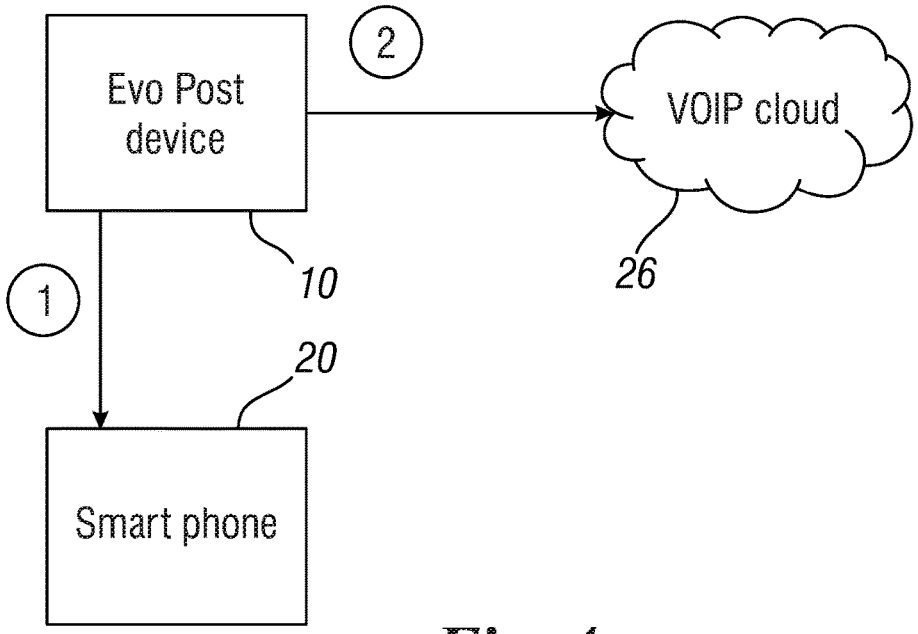
FIG. 4 is a block diagram showing the initial configuration of the apparatus for receiving and storing mail and/or parcels containing perishable products according to the present invention.

FIG. 4 shows the initial configuration procedure of the apparatus 10. This procedure involves the following steps:

- acquiring, by said remote device 20, a unique code associated with the apparatus 10; for example, this unique code can consist of a QR code which is stamped on the body 12 of the apparatus 10 and can be acquired via any Smartphone;
- transmitting the unique code to one of the cloud servers 24, 26, such as the VoIP server 26, via the user interface device 16;
- registering the unique code and one or more predefined data associated with the remote device 20 on the VoIP server 26.

Further remote devices 20 can, therefore, be associated with the apparatus 10 simply by repeating, for each of these remote devices 20, the aforementioned steps of the initial configuration procedure. Once this initial configuration procedure has been completed, it is possible to access through each remote device 20 one or more of the following functions of the apparatus 10:

- the setting of the predefined time slots for activating the communication between the user interface device 16 and the remote device 20;
- the management of the connection modes for connecting the remote device 20 to the apparatus 10;
- the settings of the network interface device 18, such as the Wi-Fi connection settings;
- the settings of the user interface device 16, such as the settings of the tactile touch screen, the video camera 42, the microphone 34 and/or the speaker 36, or even the localization settings for locating this user interface device 16 (language, keyboard, etc.);
- the settings of the temperature conditioning device 44;
- the settings of the cloud server 24, 26.

At least some of the aforementioned functions are, therefore, also accessible remotely to allow, for example, the owner of the apparatus 10 to cancel the call service, or to command an instant opening of this apparatus 10. All remote settings can be carried out by sending messages ("chat") via the VoIP server 26. In this case, too, messages can be sent using applications existing on the market, without the need for dedicated software development.

The apparatus 10 can be configured to independently request to one of the cloud servers 24, 26, concurrently with the first connection with a specific remote device 20, a pair of VoIP addresses, one for the apparatus 10 itself and one for this specific remote device 20. These VoIP addresses will be registered in the dedicated cloud server 24, 26, that is the VoIP server 26. The apparatus 10 will then be able to communicate, that is to call and receive calls, only with one or more specific remote devices 20 defined by the owner of the apparatus 10 itself.

The installation of a specific software for managing and connecting the apparatus 10 is foreseen on each remote device 20. In the remote device 20 configuration section this software can, therefore, show a configuration QR code which will enable, with a single operation, the configuration of the remote device 20 using both commercial applications, such as Linphone or Zoiper, and a specific configuration application ("app") specifically designed to simplify all the configuration and control options of this remote device 20. Thanks to these applications the owner of the apparatus 10 will be able, by exploiting the video camera 42 which can equip said apparatus 10, to receive video calls, 10. For example, the owner of the apparatus 10 can establish a video call towards this apparatus 10 using his/her own remote device 20, thus activating a video surveillance function.

It has thus been seen that the apparatus for receiving and storing mail and/or parcels containing perishable products according to the present invention achieves the objects highlighted above. In particular, the controlled temperature compartment of the apparatus according to the present invention is useful for receiving at home, via the interactive opening methods from Smartphone or portable devices usable for ordinary emailing, online shopping and foods delivered by food delivery companies, which could not otherwise be stored, especially in summer, in the normal space intended for mail and parcels in general.

The apparatus for receiving and storing mail and/or parcels containing perishable products according to the present invention thus conceived is, however, susceptible of numerous modifications and variations, all of which falling within the scope of the same inventive concept; furthermore, all the details can be replaced by technically equivalent elements.

The scope of protection of the invention is therefore defined by the attached claims.

The invention claimed is:

1. An apparatus (10) for receiving and storing one or more mail items (M), said apparatus (10) comprising:

a body (12) provided with at least one first internal cavity (30) arranged to contain at least one said mail item (M);

at least one movable closure element (14), arranged to allow or prevent access to said first internal cavity (30);

at least one user interface device (16), configured for allowing the input and output of audio and video signals;

at least one network interface device (18), configured for putting said user interface device (16) in communication with at least one remote device (20), wherein said user interface device (16) is configured for activating a communication with said remote device (20);

at least one electronic control unit (22), configured for controlling and managing said user interface device (16), said network interface device (18) and said movable closure element (14), wherein said electronic control unit (22) is configured for generating at least one random alphanumeric code and said network interface device (18) is arranged to send said random alphanumeric code to said remote device (20); and at least one power supply device (28), the apparatus being characterized in that it comprises:

at least one second internal cavity (32), which defines at least one respective controlled temperature compartment for containing at least one perishable product, wherein said second internal cavity (32) is provided with its own closing door (40) which may or may not coincide with said movable closure element (14); and at least one temperature conditioning device (44), which is powered by said power supply device (28) and operates to control the temperature inside said second internal cavity (32), wherein said remote device (20) is configured for sending, via said network interface device (18), an unlock signal based on said random alphanumeric code to said electronic control unit (22), said unlock signal being processed by said electronic control unit (22) to unlock said movable closure element (14) or said closing door (40), so as to allow said mail item (M) to be introduced in and/or withdrawn from the first internal cavity (30) of said body (12), as well as said perishable product to be introduced in or withdrawn from the second internal cavity (32) of said body (12);

wherein said user interface device (16) is configured for sending an audio or video or text message, via said network interface device (18), to said remote device (20) in the event of non-activation of the communication between said user interface device (16) and said remote device (20); and wherein in response to receiving the audio or video or text message, said remote device is adapted to activate the temperature conditioning device.

2. The apparatus (10) according to claim 1, wherein all information or data exchanged between said apparatus (10) and said remote device (20) are managed by one or more cloud servers (24, 26).

3. The apparatus (10) according to claim 2, wherein the communication between said user interface device (16) and said remote device (20) is carried out through one or more video calls using a VoIP technology.

4. The apparatus (10) according to claim 3, wherein at least one of said cloud servers (24, 26) is a dedicated VoIP server (26).

5. The apparatus (10) according to claim 2, wherein in an initial configuration step for configuring said apparatus (10):

said remote device (20) is configured for acquiring a unique code associated with said apparatus (10);

said user interface device (16) is configured for transmitting said unique code to said one or more cloud servers (24, 26);

said one or more cloud servers (24, 26) are configured for registering said unique code and one or more predefined data associated with said remote device (20).

6. The apparatus (10) according to claim 5, wherein through said remote device (20) access is provided to one or more of the following functions of said apparatus (10):

setting of the predefined time slots for activating the communication between said user interface device (16) and said remote device (20);

management of the connection modes for connecting said remote device (20) to said apparatus (10);

settings of said network interface device (18);

settings of said user interface device (16);

settings of said temperature conditioning device (44);

settings of said cloud servers (24, 26).

7. The apparatus (10) according to claim 5, wherein said apparatus (10) is configured for autonomously requesting to one of said cloud servers (24, 26), concurrently with a first connection with said remote device (20), a pair of VoIP addresses, one for said apparatus (10) and one for said remote device (20), said VoIP addresses being registered in one of said cloud servers (24, 26), so that said apparatus (10) can only communicate with one or more said remote devices (20) defined by the owner of said apparatus (10).

8. The apparatus (10) according to claim 1, wherein said apparatus (10) is provided with at least one video camera (42) and an audio input (34) and output (36) system, so as to establish a video call between said remote device (20) and said apparatus (10) for activating a video surveillance function.

9. The apparatus (10) according to claim 1, wherein said at least one temperature conditioning device (44) is inserted in the body (12) of said apparatus (10).

10. The apparatus (10) according to claim 1, wherein said temperature conditioning device (44) consists of at least one refrigerating machine.

11. The apparatus (10) according to claim 1, wherein said temperature conditioning device (44) consists of one or more thermoelectric devices.

* * * * *